US007201206B2

(12) United States Patent
Griebel

(10) Patent No.: US 7,201,206 B2
(45) Date of Patent: Apr. 10, 2007

(54) SECTIONAL LIFTING DOOR OR FOLDING DOOR

(75) Inventor: Edgar Griebel, Ochsenfurt (DE)

(73) Assignee: Niewöhner Industrie GmbH, Güterslohr (DE)

( * ) Notice: Subject to any disclaimer, the term of this patent is extended or adjusted under 35 U.S.C. 154(b) by 0 days.

(21) Appl. No.: 10/181,971

(22) PCT Filed: Jan. 18, 2001

(86) PCT No.: PCT/DE01/00224

§ 371 (c)(1),
(2), (4) Date: Nov. 7, 2002

(87) PCT Pub. No.: WO01/55543

PCT Pub. Date: Aug. 2, 2001

(65) Prior Publication Data

US 2003/0141023 A1 Jul. 31, 2003

(30) Foreign Application Priority Data

Jan. 24, 2000 (DE) ..... 100 02 980
Jul. 29, 2000 (DE) ..... 100 37 329

(51) Int. Cl.
*E06B 3/48* (2006.01)

(52) U.S. Cl. ..... 160/116

(58) Field of Classification Search ..... 160/115, 160/116, 113, 133, 180, 201, 107; 49/169, 49/340

See application file for complete search history.

(56) References Cited

U.S. PATENT DOCUMENTS 1,112,071 A * 9/1914 Knopf ..... 160/116
1,413,895 A * 4/1922 Bretos et al. ..... 160/116
1,515,929 A * 11/1924 Bretos et al. ..... 160/116
1,549,714 A * 8/1925 Bretos et al. ..... 160/116
1,989,657 A * 1/1935 McCloud ..... 160/116
3,022,817 A 2/1962 Cafardi
4,120,072 A * 10/1978 Hormann ..... 160/201 X
4,383,569 A * 5/1983 Labelle ..... 160/116
4,603,723 A 8/1986 Sugihara
4,745,708 A 5/1988 Roche
5,577,541 A * 11/1996 McKeon ..... 160/133 X (Continued)

FOREIGN PATENT DOCUMENTS

BE 528 030 A 1/1957

(Continued)

*Primary Examiner*—Blair M. Johnson
(74) *Attorney, Agent, or Firm*—Birch, Stewart, Kolasch & Birch, LLP

(57) ABSTRACT

A segmented lifting or folding gate, which is vertically movable and has a plurality of segments, adjacent segments being pivotable relative to one another at their ends along horizontally extending pivot axes, comprising a door, which includes cases and a door leaf. The door leaf being formed of a plurality of door leaf segments, which are pivotable relative to one another and whose pivot axes extend coaxially to the pivot axes of the gate segments, and wherein the door leaf extends to the floor when the gate is closed, the door leaf or the case being provided with at least one opening, at least one sliding bolt being arranged axially in the floor region of the case or of the door leaf, so as to be horizontally displaceable in the main plane of the gate, and the sliding bolt engaging in the opening when the door is closed.

28 Claims, 5 Drawing Sheets

U.S. PATENT DOCUMENTS

| | | | | |
|---|---|---|---|---|
| 5,673,740 | A * | 10/1997 | Park | 160/180 X |
| 6,006,814 | A * | 12/1999 | Dalpe | 160/116 |
| 6,227,278 | B1 * | 5/2001 | Forsland | 160/107 |
| 6,338,693 | B1 * | 1/2002 | Scholten et al. | 49/340 X |

FOREIGN PATENT DOCUMENTS

| | | |
|---|---|---|
| DE | 38 35 055 A | 4/1990 |
| EP | 0 936 339 A | 8/1999 |

* cited by examiner

A - A

SECTIONAL LIFTING DOOR OR FOLDING DOOR

This application is the national phase under 35 U.S.C. § 371 of PCT International Application No. PCT/DE01/00224, which has an International filing date of Jan. 18, 2001, and which designated the United State of America.

BACKGROUND OF THE INVENTION

1. Field of the Invention

The present invention relates to a segmented lifting or folding gate, which is vertically movable and has a plurality of segments. Adjacent segments are pivotable relative to one another at their ends along horizontally extending pivot axes. The folding gate includes a door, which has cases and a door leaf. The door leaf is formed of a plurality of door leaf segments, which are pivotable relative to one another and whose pivot axes extend coaxially to the pivot axes of the gate segments. The door leaf or the case is provided with at least one opening, at least one sliding bolt being displaceable axially, horizontally in the main plane of the door, and the sliding bolt engaging in the opening when the door is closed.

2. Description of the Background Art

Segmented lifting or folding gates have been known for a long time and are usually formed of lamellar, essentially rectangular plate-shaped segments, two vertically adjacent segments extending along a common, horizontal pivot axis, which extends parallel to longitudinal sides of the segments, and are pivotable with respect to one another. As a material for the segments, inter alia, light metals such as aluminum are used. A distinction is here made between lifting gates, in which the segments are pivoted essentially through 90° during lifting and when open the gate extends parallel to the ceiling; and folding gates, in which the adjacent segments are folded together in the manner of a concertina during opening in order to be able to close large-area openings in buildings, for example garage gates or industrial gates, without using rigid gate wings which swing out to an extended amount.

To allow passage of the gates for an individual person, without the need to open the entire gate, it is known to integrate doors in these gates, the door leaf also being composed of a plurality of segments which are pivotable relative to one another, and the pivot axes of these door leaf segments extend coaxially to the above-described pivot axes. To increase the stability of the construction, the door is installed in a door frame having vertically and horizontally extending cases. It should be possible to use these doors as escape doors, for example in the event of a fire, if the gate cannot be opened in a conventional manner. Such gates are disclosed in EP-A-0 936 339 and U.S. Pat. No. 4,603,723, which have cases or thresholds extending on the underside of the gate in the region of the door, individual segments of the door being in connection with the gate via horizontally extending sliding bolts. DE-A-3835055 finally is the only one to show a door integrated into the gate.

A disadvantage in the case of the gates known hitherto, with an integrated door, can be seen in the fact that, on the underside of the doors, a horizontally extending case or threshold is always arranged, which, particularly in emergencies, when rapid departure from the building is necessary, represents a trip threshold, over which persons can fall and injure themselves, or the evacuation of the building is delayed. This threshold has so far been regarded as indispensable, since on one hand it serves to provide the entire gate construction with sufficient stability when the gate is closed and on the other hand prevents a torsion of the floor section perpendicular to the main plane of the gate when the gate is opened. With interlocking contact of the door leaf, this stable door frame surrounding the door opening also prevents the pivotable segments of the door leaf moving relative to the gate. This threshold is also the reason why such doors are not approved as an escape route.

SUMMARY OF THE INVENTION

It is therefore an object of the present invention to provide a lifting or folding gate with a door such that the horizontally extending floor threshold below the door leaf can be eliminated without affecting the constructional stability of the gate, and a torsion of the gate segments or a relative movement of the door leaf with respect to the gate does not occur during opening.

This object is achieved according to the invention in that the door leaf extends to the floor when the gate is closed, and the sliding bolt is arranged in the floor region of the case.

The gist of the invention is in the fact that the door leaf is fixed, by at least one sliding bolt and at least one co-moving locking element, relative to the case and thereby relative to the gate. The sliding bolt is displaceable axially, that is to say along its longitudinal axis, extending in a horizontal direction in the main plane of the gate. It may be arranged either in the door leaf or in the case surrounding the door. For fixing, an opening is provided in the case or in the door leaf, which corresponds to the displaceable sliding bolt, that is to say its depth and/or its diameter is matched to the dimensions of the sliding bolt. For locking the door leaf when closed, the sliding bolt, which is arranged in the floor region of the door leaf or of the case, is displaced axially, and thereby engaged in the opening, and a movement of the door leaf, or of the floor segment perpendicular to the main plane of the door is prevented. To this end, the sliding bolt is, in an ideal case, arranged on the side of the door leaf opposite the door hinges, on which the door handle and lock are disposed.

This object is achieved according to the invention in that the door leaf extends to the floor when the gate is closed, the door leaf or the case is provided with at least one opening, at least one sliding bolt is arranged axially in the floor region of the case or of the door leaf, so as to be horizontally displaceable in the main plane of the gate, and the sliding bolt engages in the opening when the door is closed.

The invention further provides that the door leaf is fixed by at least one sliding bolt and at least one co-moving locking element relative to the case and thereby relative to the gate. The sliding bolt is displaceable axially, that is to say along its longitudinal axis, extending in a horizontal direction in the main plane of the gate. It may be arranged either in the door leaf or in the case surrounding the door. For fixing, an opening is provided in the case or in the door leaf, which corresponds to the displaceable sliding bolt, that is to say its depth and/or its diameter is matched to the dimensions of the sliding bolt. For locking the door leaf when closed, the sliding bolt, which is arranged in the floor region of the door leaf or of the case, is displaced axially, and thereby engaged in the opening, and a movement of the door leaf, or of the floor segment perpendicular to the main plane of the door is prevented. To this end, the sliding bolt is in an ideal case arranged on the side of the door leaf opposite the door hinges, on which the door handle and lock are disposed.

An advantage of the invention is that, by virtue of the extension of the door leaf to the floor, that is to say the lack of a potential trip obstacle in the form of a door threshold, this door can be used as an escape route. In addition, on lifting of the gate, at least the floor segment of the door leaf is fixed relative to the surrounding gate section, and thereby a torsion of the gate, or a relative movement of the door leaf with respect to the gate is prevented.

An advantageous further embodiment of the invention is in the sliding bolt, during displacement into the opening, pressing or pushing a locking element (for example, a pawl) sidewards, the latter, with an end formed as a detent, catching behind the edge of a retaining plate, also described as an abutment, on the door or gate segment, and engaging. By the pivoting and subsequent engagement of the locking element, movement of the door leaf or at least of its floor segment in the main plane of the gate itself is prevented.

If the sliding bolt is arranged in the door leaf and the associated opening in the case, then the locking element must also be located in the case and engages behind the retaining plate, which is then mounted on the door leaf.

Advantageously the door leaf and the cases surrounding the door are each equipped with a plurality of the above-described sliding bolts and locking elements. The door leaf can thereby be fixed at multiple points, and in particular with a door leaf composed of a plurality of segments, the sliding bolts and locking elements can be arranged in the lateral lower and/or upper edge regions of the door to avoid a relative movement of the individual door leaf segments.

It is proposed to dispose the axially displaceable sliding bolts in the case and the thereto corresponding openings in the door leaf. In this embodiment it is possible also to accommodate the below-described drive of the sliding bolts on or in the region of the cases, that is to say in the gate.

Alternatively thereto, the sliding bolts can also be disposed in the door leaf and the openings in the case. The energy supply, for example an electrical lead for an electrical bolt drive, can thereby be guided in an appropriate manner, for example with flexible cables, from the gate into the door leaf.

For driving the sliding bolts, it is proposed that they are movable electromagnetically, for example, via electrical servomotors or with magnetic switches, hydraulically or pneumatically by, for example, hydraulic or pneumatic systems known to the person skilled in the art. Mechanical movement of the sliding bolt may take place, for example, in the manner of a snap lock used in conventional doors, that is to say the sliding bolt is moved by spring force and engaged in the opening. To this end the tip of the sliding bolt may also be rounded in a hemispherical manner to permit engagement and disengagement out of the opening. Furthermore, it is known to the person skilled in the art to provide any arbitrary mechanical device, which locks the sliding bolt in the closed position as soon as the door lifted.

A further advantageous embodiment of the invention is that a vertical arrangement, on the underside of the door leaf, further bolts in the main plane of the gate, which are possibly displaceable and, when the gate is closed, can engage in the corresponding opening in the floor. An additional displacement, which may be desirable or required for security considerations, of the bolts can also be implemented in the above-described manner. In both embodiments, the bolts initially serve to stabilize the door when closed, that is to say that a movement of the gate and of the door perpendicular to its main plane is prevented. Such a movement, for example under the influence of a strong wind pressure, would in the long term lead to damage of the gate. The additional displaceability of the bolts by, for example, a drive, particularly in the region of the door serves as additional securing against unauthorized use.

Advantageously the length of the bolts is three to eight times that of the bolt diameter. With a suitable choice of material, in particular metal or stainless steel, bolts with such dimensions can receive a maximum flexural moment perpendicular to their longitudinal axis without deforming under its effect.

In an advantageous embodiment of the invention, by at least two of the vertically arranged bolts, the axially displaceable sliding rods, the movement of the sliding bolts can be driven. To this end the upper region of the two sliding rods can be formed as a toothed rack, which on its vertically upward movement, is deflected via gear wheels and a steel strip, and draws the sliding bolt out of the associated opening.

Here the sliding bolt is advantageously moved against a compression spring, which is tensioned by the movement.

Overall, on closing of the gate the sliding bolt is moved back and the door is released. During the opening of the gate, the sliding bolts, driven by the relaxation of the compression springs, spring back into the openings and lock the door.

Simultaneously with this operation the door segments are secured by the locking elements, which engage behind the retaining plates as described above.

Overall, by these jointly acting devices, the door is locked when the gate is opened and released for use after it is closed.

To increase the reliability of use of the gate, it is proposed that, at the lower edge of the gate, an electromagnetic safety strip, which is known per se, is arranged, with which a strip-shaped transmitter can be moved in a vertical direction against a spring force.

If, on closing of the gate, an object or a person is located below the gate, the contact strip is moved relatively to the gate by the resistance of the object, and an electrical contact is made, which is connected to an automatic cut-off for the gate drive. Advantageously, the safety strip is of three-part design, that is to say that a strip is mounted to the left and right of the gate and on the door at the bottom edge in each case. Here, the person skilled in the art can advantageously connect the strips to one another in a suitable manner, such that, on tripping even of only one strip, the automatic cut-off responds and the gate drive cuts off. Safety is thus ensured in the event of obstruction under all three gate parts.

A further advantage is provided by a device with which that part of the safety contact strip mounted on the lowermost door leaf segment can be vertically pivoted or lifted, because the door can only be opened easily if the contact strip is not lying on the floor.

To lift the contact strip from the floor, a drive can be installed, which is activated when the door is opened, for example even when the door latch is operated.

To allow use of the door also as an escape route, it is equipped with a panic lock known to the person skilled in the art. This permits the opening of even a locked door from the inside, for example by simply pushing down the door latch. By this means, the rapid evacuation of persons from a building is permitted, even when they do hot have a suitable key for the door.

With a drive of the vertically extending bolts provided on the lower edge of the door, it is recommended to actively connect it to the door handle or the door lock. That means that, on operation of the door handle or door lock, for example to open the door, the bolts are displaced synchronously. To open the door, they must be drawn upwards out of the openings in the floor and inserted during closing.

The drive of the bolts may also take place here as described above, and, for example on opening of the doors, an electrical contact may be made, which sets an electrical or magnetic bolt drive into movement. In particular, an active mechanical connection between the bolt and door handle is proposed, which has a rack, the latter being equipped at the level of the door lock with a toothed rack, which engages directly with a toothed quadrant, which is pivoted via the door latch about a horizontal axis. The rack and the sliding bar connected to the bolt should be pivoted relative to one another at the level of the horizontal pivot axis, at which the individual adjacent segments can be pivoted relative to one another, and should also have a coaxial joint to permit the buckling or folding operation on opening of the gate.

To prevent a movement of the door leaf in a horizontal direction in the main plane of the gate, the door leaf and/or the vertical cases are equipped with hook-like devices, which, when the door is closed, catch behind correspondingly formed projections on the cases or door leaf. In particular, these hooks are disposed in the region of the bolts to prevent pulling open of the gap between the door leaf and case, for example during opening.

A further advantageous embodiment of the invention is to provide a pressure roller, which is mounted on both narrow sides of the gate in the lower region and on closing of the gate runs on a centering or locking curve, which is mounted in the lower region of the gate case. The gate and the door are thereby brought together in the lower region, their position is fixed and the bolts are centered over the openings.

It is therefore achieved that the sliding bolts are introduced with accurate fit into the opening, the locking element being pivoted such that it engages behind the retaining plate and at the same time makes the electrically conducting contact between the individual parts of the safety contact strip.

In order that the goal of a precise centering is achieved, which ensures perfect functioning of the locking mechanism, the height of the centering or locking curve is advantageously designed so as to be variably settable, so that it can be adjusted at any time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
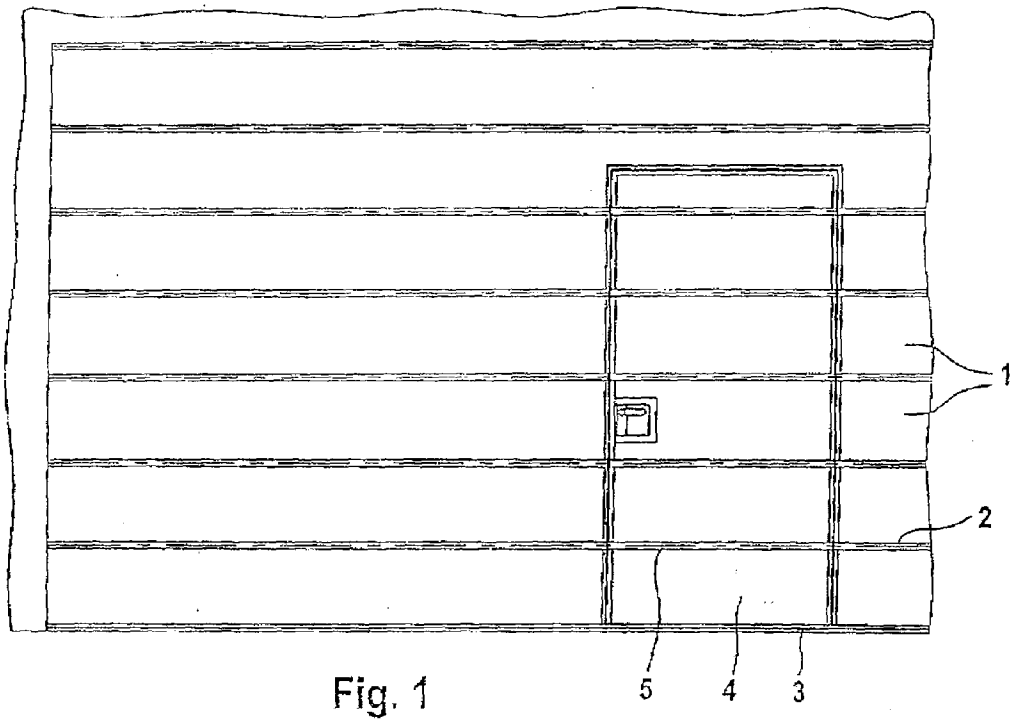
FIG. 1 shows a segmented lifting gate with door in elevation.

The exemplary embodiment shown in FIG. 1 of the invention is a segmented lifting door, which has a plurality of essentially rectangular segments (1), which are pivotable relative to one another parallel to their longitudinal sides on horizontally extending pivot axes (2). To permit passage of a gate for persons, without the gate itself needing to be opened, a door is inserted, whose door leaf in turn includes individual door leaf segments (4). Horizontal pivot axes (5) between adjacent door segments (4) are arranged coaxial to the horizontally extending pivot axes (2) of the gate. At the lower edge of the gate and the door, a three-part electrical safety contact strip (3) is mounted, which is coupled to an automatic cut-out for the gate drive.

Figure 2:
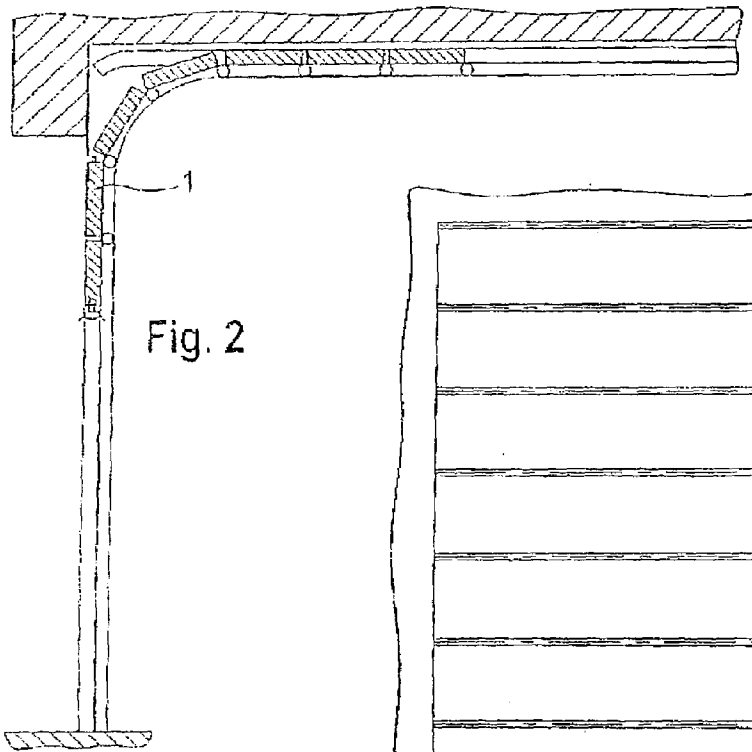
FIG. 2 shows the gate in a semi-lifted state in cross-section.

FIG. 2 shows the lifting gate in a semi-lifted state. Here, in the angle between the wall and ceiling, a pivoting of the individual segments (1) through essentially 90° takes place such that the gate extends parallel to the ceiling when it is completely opened.

Figure 3:
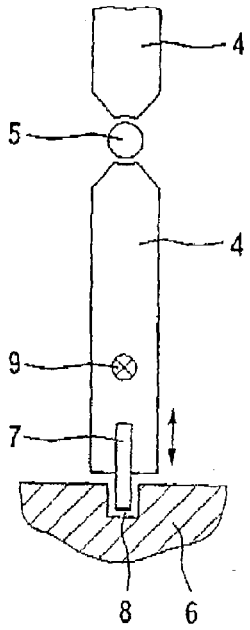
FIG. 3 shows the floor door segment in horizontal cross-section.

FIG. 3 shows the two lowermost door leaf segments (4) of a door, according to a preferred embodiment of the invention, of a lifting gate when closed. The lowermost segment (4) is essentially interlocked with its lower edge on the floor (6). For sealing, an additional rubber lip can be attached to the lowermost segment. A bolt (7), which is arranged in the main plane of the gate and is axially displaceable possibly in a vertical direction, engages into a corresponding opening (8) in the floor (6) below the gate, as indicated by the arrow. Movement of the gate or of the door perpendicular to the plane of the gate, for example under the effect of wind pressure, is prevented. Between the two segments (4), a pivot axis (5), which can be of any on which the two segments (4) can be pivoted relative to one another. Furthermore, a sliding bolt (9) is shown, which can be caused to engage in a case (10), wherein it can be displaced axially, substantially parallel to the floor. To simplify the diagram, a drive device for the bolts (7, 9) has not been illustrated. The drive device for the bolts can be, for example, electromagnetic, pneumatic or mechanical, and can also be connected to suitable control electronics.

Figure 4:
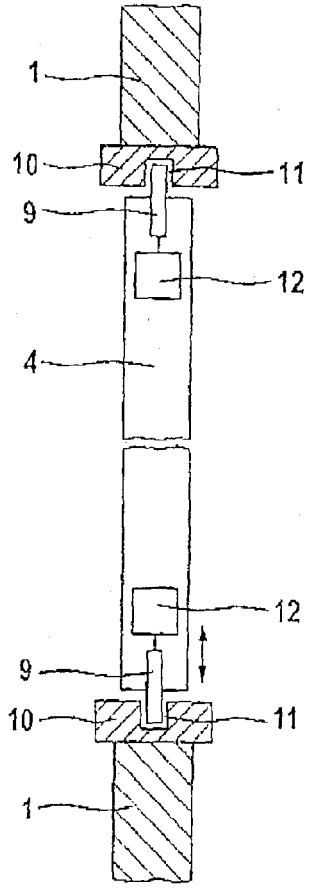
FIG. 4 shows a vertical cross-section through the door.

FIG. 4 shows the segment (1) of a gate comprising a segment (4) of the door leaf shown in vertical cross-section. In the door leaf, the sliding bolt (9) is arranged laterally on the left and right, and can be displaced axially in the horizontal direction in the main plane of the gate, as is indicated by the arrow. The sliding bolt 9 may be brought into engagement with a corresponding opening (11) in the case (10), which is arranged so as to surround the door openings on three sides. To actuate the sliding bolt (9), a freely optional actuator (12) is used.

Figure 5:
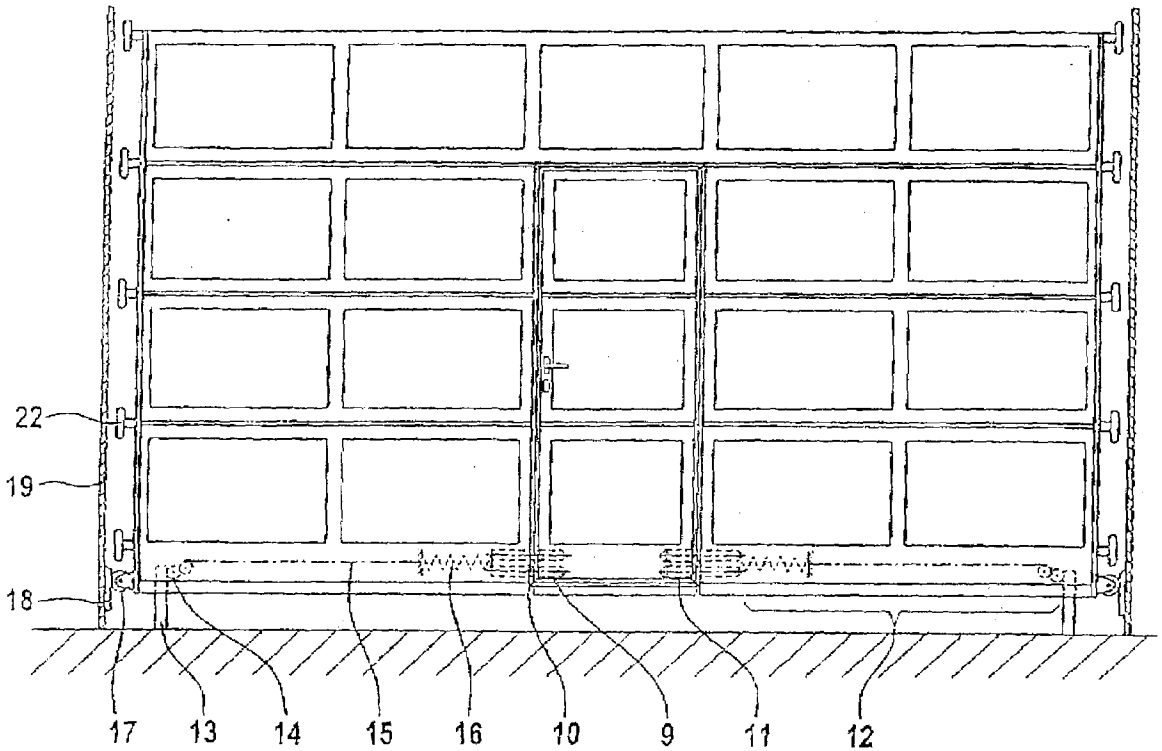
FIG. 5 shows another side elevational view of a segmented lifting gate with door.

FIG. 5 shows a vertical section through the gate at the height of the rollers. In the lower region of the gate, two sliding rods (13), which are designed as a toothed rack, and whose movement is deflected by gear wheels (14) (pinions) and a steel strip (15) to the sliding bolt (9). During closing of the door, the steel strip (15) is unrolled. It thereby pulls the sliding bolts (9) out of the openings and tensions compression springs (16), whose spring force, on relaxation of the springs, during opening of the gate, pushes the sliding bolts (9) back into the openings (11).

At the narrow side of the gate, the pressure rollers (17) are mounted, which, during closing of the gate run along a centering or locking curve (18) to center the gate. During opening of the gate, they run in the upper region of the gate case on rails (19) or freely.

Figure 6:
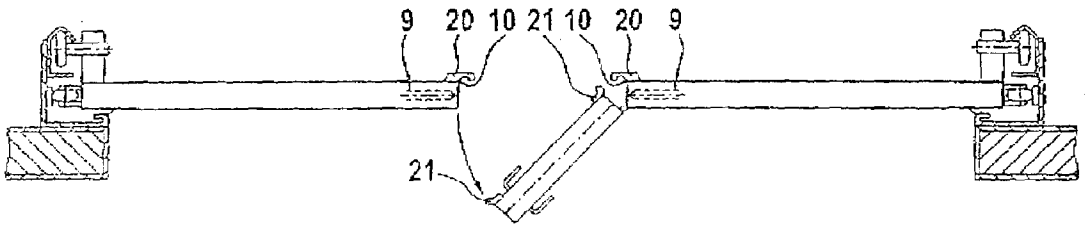
FIG. 6 shows a horizontal cross-section through the gate in the region between the door latch and the door top edge.

FIG. 6 shows a horizontal section through the gate with a partly open door. Retaining plates (20) or abutments arranged on the door case can be clearly recognized, behind which locking elements (21) (e.g. pawls) are arranged on the door and engage in order to fix the door in the case (10).

Figure 7:
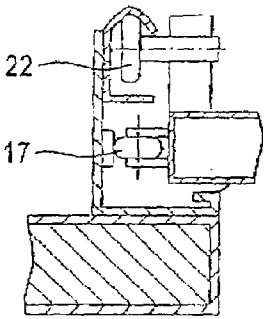
FIG. 7 shows a detail from FIG. 6.

FIG. 7 shows a detail of FIG. 6, in which the arrangement of rollers (22) and the pressure roll (17) is shown.

Figure 8:
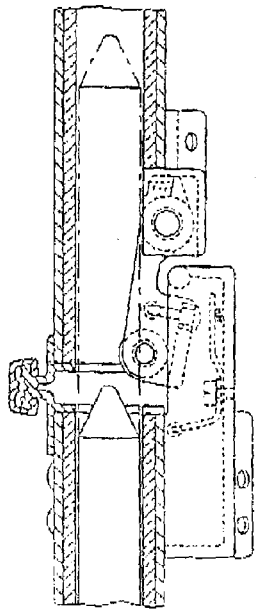
FIG. 8 shows a detail in the region of the door case of the horizontal cross-section through the door.

FIG. 8 shows a section through the door and the door case at the level of the sliding bolts (9). Holding strips (20) and the locking element (21) are recognizable, which projects into the movement cross-section of the sliding bolt (9) and during displacement of the sliding bolt (9) is pivoted by the latter such that the end designed in the form of a detent engages behind the edge of the retaining plates (20) on the individual gate segment or door segment.

Figure 9:
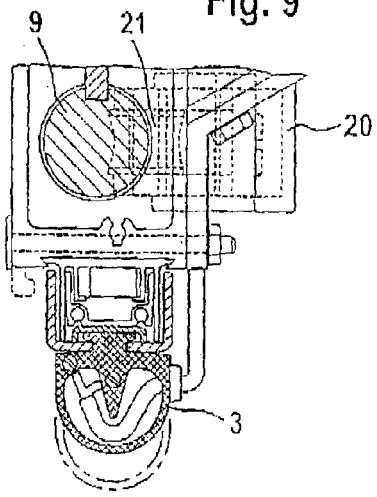
FIG. 9 shows a detail in the lower region of the door from the vertical cross-section through the door.
Figure 9:
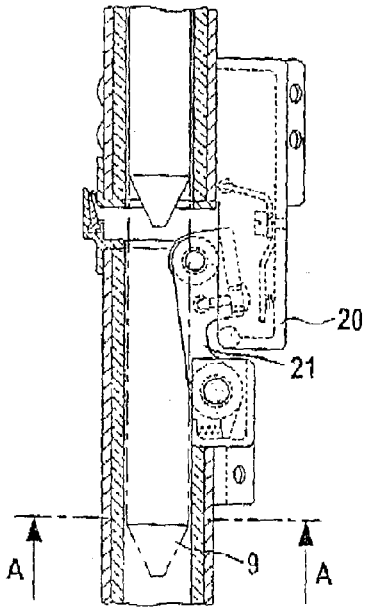

FIG. 9 shows a cross-section through the lower region of the door. The safety contact strip (3) and the locking element (21) projecting into the movement cross-section of the shear bolt (9) and the retaining plate (20) can be clearly seen.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A segmented gate, which is vertically movable, comprising:

a plurality of segments, adjacent segments being pivotable relative to one another at their ends along horizontally extending pivot axes; and a door opening and a door being formed in a portion of the plurality of segments, a case composed of segments and surrounding the door opening on three sides excluding the bottom side of the door, the door including a door leaf, the door leaf being composed of a plurality of door leaf segments, which are pivotable relative to one another and whose pivot axes extend coaxially to the pivot axes of the plurality of segments, the door leaf or the case including:

at least one opening; and at least one sliding bolt being displaceable parallel to a floor, the floor serving as an end-stop of the segmented gate, the sliding bolt engaging in the opening when the door is closed, at least one compression spring coupled to the at least one sliding bolt; and a spring relaxation mechanism to relax the at least one compression spring;

wherein on closing of the segmented gate, the at least one sliding bolt is moved back and the door is released to permit the door to be opened and, wherein on opening of the gate, the relaxation mechanism relaxes the compression springs to cause the at least one sliding bolt to engage with the openings and lock the door.

2. The segmented gate according to claim 1, wherein the sliding bolt, during displacement into the opening, presses or pushes a locking element sidewards, the locking element having an end formed as a detent, which catches and is behind an edge of a retaining plate on the door or gate segment.

3. The segmented gate according to claim 1, further comprising a plurality of sliding bolts for fixing the door leaf relative to the case in the lower and upper lateral edge regions of the door leaf, and a plurality of locking elements mounted on the door leaf.

4. The segmented gate according to claim 1, further comprising retaining plates and wherein the sliding bolt and retaining plates are arranged in the case and the opening and locking elements are arranged in the door leaf.

5. The segmented gate according to claim 1, further comprising retaining plates and wherein the sliding bolt and retaining plates are arranged in the door leaf and the opening and locking elements are arranged in the case.

6. The segmented gate according to claim 1, wherein the sliding bolt is electromagnetically or hydraulically or pneumatically or mechanically moveable.

7. The segmented gate according to claim 1, wherein, in a lower edge region of the door leaf, one or more locking bolts are arranged vertically in the main plane of the segmented gate and are provided such that, when the door and the segmented gate are closed, the one or more locking bolts engage or engages in one or more openings in the floor.

8. The segmented gate according to claim 7, wherein the length of the sliding bolt or the locking bolts corresponds to three to eight times their diameter.

9. The segmented gate according to claim 7, wherein a plurality of vertically arranged locking bolts are provided, and wherein at least two of the vertically arranged locking bolts are axially movable.

10. The segmented gate according to claim 9, wherein the locking bolts are vertically displaceable rods and drive the movement of the sliding bolt.

11. The segmented gate according to claim 10, wherein the rods are designed as a toothed rack in the upper region, the movement of which draws, via gear wheels and a steel strip, the sliding bolts out of the associated openings.

12. The segmented gate according to claim 11, wherein the sliding bolt is drawn out of the opening against a compression spring, which is tensioned by the movement.

13. The segmented gate according to claim 1, wherein, on the bottom edge of the gate, an electrical safety contact strip is provided.

14. The segmented gate according to claim 13, wherein an automatic cut off for a gate drive is designed electrically such that it responds even in the event of resistance against a single part of the electrical safety contact strip and shuts off the gate drive.

15. The segmented gate according to claim 13, wherein a portion of the safety contact strip, which is mounted on the lowermost door leaf segment, can be pivoted or lifted vertically.

16. The segmented gate according to claim 15, wherein the vertically pivotable or liftable part of the safety contact strip is moved by a correspondingly designed drive during opening of the door.

17. The segmented gate according to claim 14, wherein the gate drive is controlled by means of an active connection with the door latch during opening.

18. The segmented gate according to claim 1, wherein a panic lock is mounted on the door.

19. The segmented gate according to claim 9, wherein the locking bolts are displaceable and are in active connection with a door handle and/or a door lock.

20. The segmented gate according to claim 17, wherein the active connection is electromagnetic or hydraulic or pneumatic or mechanical, in particular, with a mechanical active connection via a rack, the mechanical active connection being pivotable at a level of the horizontal pivot axes.

21. The segmented gate according to claim 1, wherein the door leaf and/or the cases are provided with projections formed as hook-shaped hook devices, the projections engaging on the cases that are vertical and/or laterally on the door leaves.

22. The segmented gate according to claim 1, wherein, on narrow sides in a lower region of the gate, there is mounted a pressure roller, which, as the door is being closed, runs on a centering or locking curve, which is mounted on the lower region of a gate case.

23. The segmented gate according to claim 22, wherein the pressure rollers run on runners in the remaining region of the gate case or freely.

24. The segmented gate according to claim 22, wherein a running level of a centering or locking curve is variably adjustable.

25. The segmented gate according to claim 13, wherein the electrical safety contact strip is in three parts.

26. A gate assembly comprising:

a plurality of segments being hingedly attached to one another along segment pivot axes for enabling entrance to an opening of a structure in an open position and for substantially covering the opening of the structure in a closed position, a lower segment of the plurality of segments being adapted to be substantially adjacent to a floor of the structure in the closed position;

a door opening and a door being formed in a portion of the plurality of segments, a case composed of segments and surrounding the door opening on three sides excluding the bottom side of the door, for enabling entrance to the opening when the plurality of segments is in the closed position, the door having a plurality of door segments that are hingedly attached to one another along door segment pivot axes, the door segment pivot axes being parallel to the segment pivot axes, a lower door segment of the plurality of door segments being adapted to be substantially adjacent to the floor when the plurality of segments are in the closed position so that a lower edge of the lower door segment of the plurality of door segments is aligned with a lower edge of the lower segment of the plurality of segments, thereby forming a uniform plane; and the door including:

at least one sliding bolt being displaceable parallel to a floor, the floor serving as an end-stop of the segmented gate, the sliding bolt engaging in the opening when the door is closed, at least one compression spring coupled to the at least one sliding bolt; and a spring relaxation mechanism to relax the at least one compression spring;

wherein, on closing of the segmented gate, the at least one sliding bolt is moved back and the door is released to permit the door to be opened and, wherein on opening of the gate, the relaxation mechanism relaxes the compression springs to cause the at least one sliding bolt to engage with the openings and lock the door.

27. The gate assembly according to claim 26, further comprising a locking assembly for automatically locking the door to the plurality of segments when the gate assembly transitions from the closed position to the open position and for automatically unlocking the door from the plurality of segments to enable access to the structure through the door when the gate is in the closed position.

28. A gate assembly comprising:

a plurality of segments, adjacent segments being pivotable relative to one another at their ends along horizontally extending pivot axes;

a door comprising a plurality of door leaf segments, which are pivotable relative to one another and whose pivot axes extend coaxially to the pivot axes of the segments;

at least one sliding bolt;

an opening in the gate for receiving the sliding bolt;

at least one compression spring;

a compression spring relaxation mechanism;

wherein, on closing of the segmented gate, the at least one sliding bolt is moved back from the opening and the door is released to permit the door to be opened and, wherein on opening of the gate, the relaxation mechanism relaxes the compression springs to cause the at least one sliding bolt to engage with the openings and lock the door.

* * * * *